US006062445A

United States Patent [19]

Nakamoto

[11] Patent Number: 6,062,445

[45] Date of Patent: May 16, 2000

[54] GARMENT HANGER WITH EXTENDABLE SHOULDER WINGS

[76] Inventor: Eric H. Nakamoto, 1239 19th St. #7, Santa Monica, Calif. 90404

[21] Appl. No.: 09/231,377

[22] Filed: Jan. 14, 1999

[51] Int. Cl.[7] ..... A47G 25/40

[52] U.S. Cl. ..... 223/94; 223/89

[58] Field of Search ..... 223/85, 94, 89, 223/98, 92, 88

[56] References Cited

U.S. PATENT DOCUMENTS

| | | | |
|---|---|---|---|
| 2,494,711 | 1/1950 | Kusher et al. | 223/94 |
| 2,613,858 | 10/1952 | Sprague | 223/94 |
| 2,620,102 | 12/1952 | Bremer | 223/94 |
| 2,900,117 | 8/1959 | Veltry | 223/94 |
| 3,214,071 | 10/1965 | Brodesser | 223/94 |
| 5,044,535 | 9/1991 | Hunt | 223/95 |
| 5,145,098 | 9/1992 | Tung | 223/94 |
| 5,456,391 | 10/1995 | Chang | 223/94 |

*Primary Examiner*—Bibhu Mohanty

[57] ABSTRACT

A garment hanger with extendable shoulder wings for permitting adjustable lengthening and shortening of the span between the shoulder wings of a garment hanger. The garment hanger includes a mast member having upper and lower ends, and a longitudinal axis extending between the upper and lower ends. A hook upwardly extends from the upper end of the mast member. A pair of elongate arms outwardly extend from the mast member adjacent the lower end of the mast member. A pair of shoulder wings are provided each having a proximal end and a distal end. The proximal end of each of the shoulder wings has an elongate bore therein. One of the arms is inserted into the elongate bore of one of the shoulder wings. Another of the arms is inserted into the elongate bore of another of the shoulder wings.

7 Claims, 2 Drawing Sheets

10
11
12
13
14
15
16
17
18
19
20
21
22
23
28
29
30
4
4

GARMENT HANGER WITH EXTENDABLE SHOULDER WINGS

BACKGROUND OF THE INVENTION

1. Field of the Invention

The present invention relates to extendable garment hangers and more particularly pertains to a new garment hanger with extendable shoulder wings for permitting adjustable lengthening and shortening of the span between the shoulder wings of a garment hanger.

2. Description of the Prior Art

The use of extendable garment hangers is known in the prior art. More specifically, extendable garment hangers heretofore devised and utilized are known to consist basically of familiar, expected and obvious structural configurations, notwithstanding the myriad of designs encompassed by the crowded prior art which have been developed for the fulfillment of countless objectives and requirements.

Known prior art garment hangers include U. S.Pat. No. 5,082,152; U.S. Pat. No. 5,476,199; U.S. Pat. No. 3,737,079; U.S. Pat. No. 4,673,114; U.S. Pat. No. Des. 320,313; and U.S. Pat. No. 2,504,562.

While these devices fulfill their respective, particular objectives and requirements, the aforementioned patents do not disclose a new garment hanger with extendable shoulder wings. The inventive device includes a mast member having upper and lower ends, and a longitudinal axis extending between the upper and lower ends. A hook upwardly extends from the upper end of the mast member. A pair of elongate arms outwardly extend from the mast member adjacent the lower end of the mast member. A pair of shoulder wings are provided each having a proximal end and a distal end. The proximal end of each of the shoulder wings has an elongate bore therein. One of the arms is inserted into the elongate bore of one of the shoulder wings. Another of the arms is inserted into the elongate bore of another of the shoulder wings.

In these respects, the garment hanger with extendable shoulder wings according to the present invention substantially departs from the conventional concepts and designs of the prior art, and in so doing provides an apparatus primarily developed for the purpose of permitting adjustable lengthening and shortening of the span between the shoulder wings of a garment hanger.

SUMMARY OF THE INVENTION

In view of the foregoing disadvantages inherent in the known types of extendable garment hangers now present in the prior art, the present invention provides a new garment hanger with extendable shoulder wings construction wherein the same can be utilized for permitting adjustable lengthening and shortening of the span between the shoulder wings of a garment hanger.

The general purpose of the present invention, which will be described subsequently in greater detail, is to provide a new garment hanger with extendable shoulder wings apparatus and method which has many of the advantages of the extendable garment hangers mentioned heretofore and many novel features that result in a new garment hanger with extendable shoulder wings which is not anticipated, rendered obvious, suggested, or even implied by any of the prior art extendable garment hangers, either alone or in any combination thereof.

To attain this, the present invention generally comprises a mast member having upper and lower ends, and a longitudinal axis extending between the upper and lower ends. A hook upwardly extends from the upper end of the mast member. A pair of elongate arms outwardly extend from the mast member adjacent the lower end of the mast member. A pair of shoulder wings are provided each having a proximal end and a distal end. The proximal end of each of the shoulder wings has an elongate bore therein. One of the arms is inserted into the elongate bore of one of the shoulder wings. Another of the arms is inserted into the elongate bore of another of the shoulder wings.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garment hanger with extendable shoulder wings apparatus and method which has many of the advantages of the extendable garment hangers mentioned heretofore and many novel features that result in a new garment hanger with extendable shoulder wings which is not anticipated, rendered obvious, suggested, or even implied by any of the prior art extendable garment hangers, either alone or in any combination thereof.

It is another object of the present invention to provide a new garment hanger with extendable shoulder wings which may be easily and efficiently manufactured and marketed.

It is a further object of the present invention to provide a new garment hanger with extendable shoulder wings which is of a durable and reliable construction.

An even further object of the present invention is to provide a new garment hanger with extendable shoulder wings which is susceptible of a low cost of manufacture with regard to both materials and labor, and which accordingly is then susceptible of low prices of sale to the consuming public, thereby making such garment hanger with extendable shoulder wings economically available to the buying public.

Still yet another object of the present invention is to provide a new garment hanger with extendable shoulder wings which provides in the apparatuses and methods of the prior art some of the advantages thereof, while simultaneously overcoming some of the disadvantages normally associated therewith.

Still another object of the present invention is to provide a new garment hanger with extendable shoulder wings for permitting adjustable lengthening and shortening of the span between the shoulder wings of a garment hanger.

Yet another object of the present invention is to provide a new garment hanger with extendable shoulder wings which includes a mast member having upper and lower ends, and a longitudinal axis extending between the upper and lower ends. A hook upwardly extends from the upper end of the mast member. A pair of elongate arms outwardly extend from the mast member adjacent the lower end of the mast member. A pair of shoulder wings are provided each having a proximal end and a distal end. The proximal end of each of the shoulder wings has an elongate bore therein. One of the arms is inserted into the elongate bore of one of the shoulder wings. Another of the arms is inserted into the elongate bore of another of the shoulder wings.

Still yet another object of the present invention is to provide a new garment hanger with extendable shoulder wings that permitting drying of tee-shirts thereon while providing sufficient support to the arms of the shirt so that stretch marks are not formed on the arms of the shirt.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
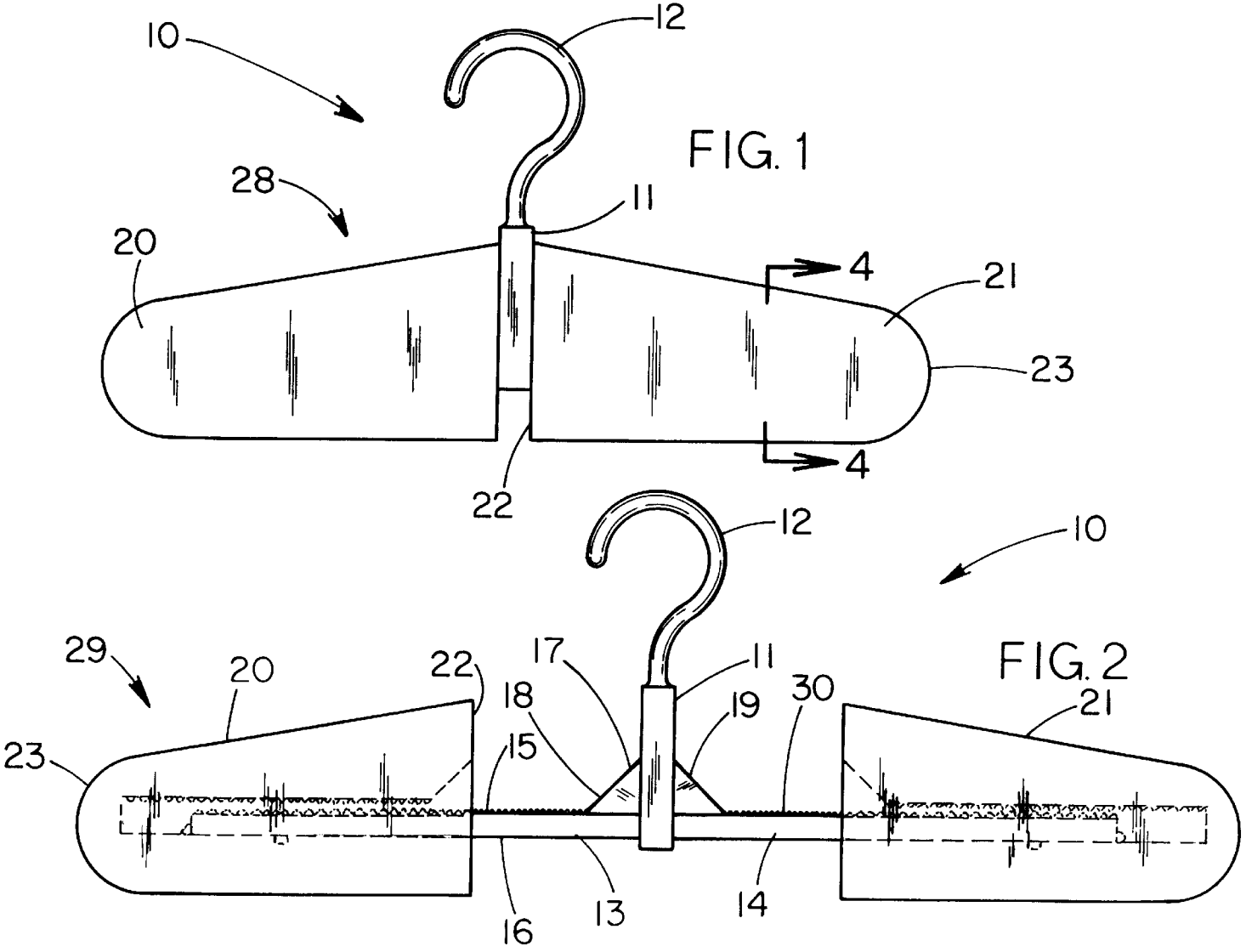
FIG. 1 is a schematic side view of a new garment hanger with extendable shoulder wings in the retracted position according to the present invention.
FIG. 2 is a schematic side view of the present invention in the extended position.
Figure 3:
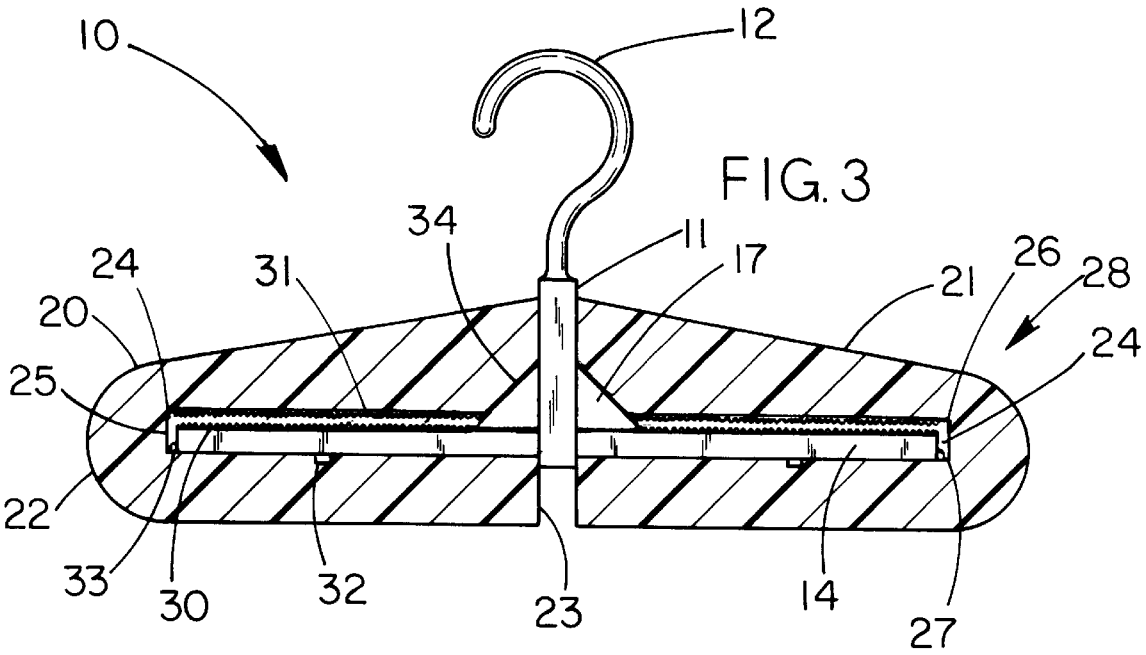
FIG. 3 is a schematic cross sectional view of the present invention in the retracted position.

With reference now to the drawings, and in particular to FIGS. 1 through 4 thereof, a new garment hanger with extendable shoulder wings embodying the principles and concepts of the present invention and generally designated by the reference numeral 10 will be described.

As best illustrated in FIGS. 1 through 4, the garment hanger with extendable shoulder wings 10 generally comprises a mast member 11 having upper and lower ends, and a longitudinal axis extending between the upper and lower ends. A hook 12 upwardly extends from the upper end of the mast member 11. A pair of elongate arms 13,14 outwardly extend from the mast member 11 adjacent the lower end of the mast member. A pair of shoulder wings 20,21 are provided each having a proximal end 22 and a distal end 23. The proximal end of each of the shoulder wings has an elongate bore 24 therein. One of the arms 13 is inserted into the elongate bore of one of the shoulder wings 20. Another of the arms 14 is inserted into the elongate bore of another of the shoulder wings 21.

In closer detail, the mast member 11 has upper and lower ends, and a longitudinal axis extending between the upper and lower ends. A hook 12 upwardly extends from the upper end of the mast member. The hook is designed for hooking on to a support structure such as a hanging rod or a clothes line such that the longitudinal axis of the mast member is generally vertical extended beneath the support structure.

Figure 4:
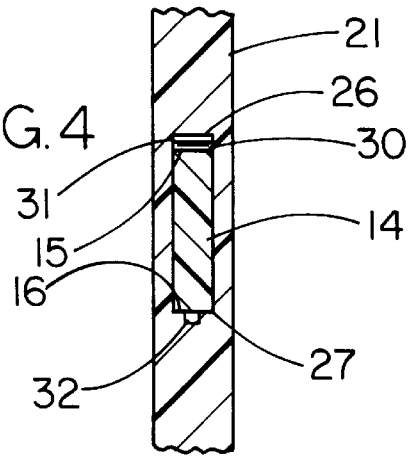
FIG. 4 is a schematic cross sectional view of the present invention taken from line 4—4 of FIG. 1.

The pair of elongate arms 13,14 outwardly extend in generally diametrically opposite directions from the mast member adjacent the lower end of the mast member. Optionally, the arms comprise a single beam extending through an aperture through the mast member adjacent the lower end of the mast member. Each of the arms 13,14 has terminal end and generally straight top and bottom side edges 15,16 extending between the associated terminal end and the mast member. Each of the arms has a longitudinal axis extending between the associated terminal end and the mast member. The longitudinal axes of the arms are preferably generally collinear and preferably extend generally perpendicular to the longitudinal axis of the mast member such that the longitudinal axes of the arms are generally vertical when the mast member is suspended from a support structure. Even more preferably, the longitudinal axes of the mast member and the arms generally lie in a common vertical plane. With reference to FIG. 4, each of the arms has a generally rectangular cross section transverse the associated longitudinal axis of the respective arm to prevent rotation of the arms in the elongate bores 24.

Preferably, the mast member has a reinforcing portion 17 adjacent the top side edges 15 of the arms for providing additional structural strength at the union of the mast member and the arms. The reinforcing portion 17 is generally triangular in configuration and has a pair of upper edges 18,19. One of the upper edges of the reinforcing portion is extended between the mast member and the top side edge of one of the arms while the other upper edge of the reinforcing portion is extended between the mast member and the top side edge of another of the arms. Preferably, the upper edges of the reinforcing portion each extend at an acute angle with respect to the longitudinal axis of the associated arm.

The pair of shoulder wings 20,21 each have a generally straight proximal end 22 and an arcuate distal end 23 opposite the associated proximal end. The proximal end of each of the shoulder wings has an elongate bore 24 therein into the respective shoulder wing. The elongate bores of the shoulder wings each has a longitudinal axis and a generally rectangular cross section transverse the longitudinal axis of the respective elongate bore (Note FIG. 4). Each of the elongate bores of the shoulder wings terminating at an end wall 25 located between the proximal and distal ends of the respective shoulder wing. Each of the elongate bores of the shoulder wings has generally straight upper and lower side walls 26,27 extending between the associated end wall and the proximal end of the respective shoulder wing.

One of the arms is slidably inserted into the elongate bore of one of the shoulder wings. The other arm is slidably inserted into the elongate bore of the other shoulder wing. In use, the arms are slidable along the longitudinal axis of the associated elongate bore such that proximal ends of the shoulder wings may be selectively slidingly positioned adjacent the mast member and away from the mast member. With reference to FIGS. 1 and 2, each of the shoulder wings is positionable between a retracted position 28 (FIG. 1) and an extended position 29 (FIG. 2). In use, the proximal ends of the shoulder wings are positioned adjacent the mast member when in the retracted position. The proximal ends of the shoulder wings are spaced apart from the mast member when in the extended position.

The distal ends of the shoulder wings 20,21 define a length therebetween. In an ideal embodiment, the length between the distal ends is about 16 inches when the shoulder wings are in the retracted position and the length between the distal ends is about 24 inches when the shoulder wings are in the extended position.

The upper side wall 26 of each of the elongate bores has a generally triangular recess 34 adjacent the associated proximal end of the respective shoulder wing designed for receiving the adjacent associated upper edge of the reinforcing portion when the shoulder wings are in the retracted position.

Preferably, the top side edge of each of the arm, has a row of resilient teeth 30 extending therealong. Similarly, the upper side wall of each of the elongate bores has a row of resilient teeth 31 extending therealong. In use, the teeth 31 of the upper side wall interlockingly engage the teeth 30 of the associated top side edge to resist sliding of the shoulder wings along the associated arm. Each of the arms has a height defined between the top and bottom side edges 15,16 and each of the elongate bores has a height defined between the upper and lower side walls 26,27. The height of each of the elongate bores is greater than the height of each of the arms to permit vertical play of the arms in the elongate bores. In use, this permits sliding of the arms in and out of the bores by abutting the bottom side edges of the arms against the lower side walls of the elongate bores so that the teeth of the top side edges and the upper side walls are disengaged from each other. Furthermore, in use, gravity biases the top side edge against the upper side wall so that the teeth are normally engaged until a user manipulates the shoulder wings to abut the bottom side edge against the lower side wall.

The lower side wall of each of the elongate bores has a notch 32 therein located between the associated end wall and the proximal end of the associated shoulder wing. The terminal end of each of the arms has a detent 33 which is insertable into the notch of the associated elongate bore to prevent positioning of the associated shoulder wing outwards past the extended position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garment hanger, comprising:

an elongate mast member having upper and lower ends, and a longitudinal axis extending between said upper and lower ends;

a hook upwardly extending from said upper end of said mast member, said hook being adapted for hooking on to a support structure, said hook having an arcuate portion and a straight portion, said straight portion extending outwardly from said arcuate portion, said straight portion being positioned substantially collinear with said longitudinal axis of said mast member;

a pair of elongate arms extending orthogonally outward from said mast member adjacent said lower end of said mast member;

each of said arms having a terminal end;

each of said arms having a longitudinal axis extending between the associated terminal end and said mast member;

a pair of shoulder wings each having a proximal end and a distal end;

said proximal end of each of said shoulder wings having an elongate bore therein;

each of said elongate bores of said shoulder wings terminating at an end wall located between the proximal and distal ends of the respective shoulder wing;

one of said arms being inserted into the elongate bore of one of said shoulder wings, another of said arms being inserted into the elongate bore of another of said shoulder wings; and each of said shoulder wings being positionable between a retracted position and an extended position, wherein said proximal ends of said shoulder wings are positioned adjacent said mast member when in said retracted position, wherein said proximal ends of said shoulder wings are spaced apart from said mast member when in said extended position; and wherein each of said arms has a generally rectangular cross section transverse the associated longitudinal axis of the respective arm for preventing twisting of said shoulder wings about said longitudinal axes of said arms.

2. The garment hanger of claim 1, wherein said longitudinal axes of said arms are generally collinear.

3. The garment hanger of claim 1, wherein said longitudinal axes of said mast member and said arms generally lie in a common plane.

4. The garment hanger of claim 1, wherein said mast member has a reinforcing portion adjacent said top side edges of said arms, said reinforcing portion being generally triangular in configuration and having a pair of upper edges, one of said upper edges of said reinforcing portion being extended between said mast member and said top side edge of one of said arms, another of said upper edges of said reinforcing portion being extended between said mast member and said top side edge of another of said arms.

5. The garment hanger of claim 1, wherein each of said elongate bores of said shoulder wings has upper and lower side walls extending between the associated end wall and the proximal end of the respective shoulder wing, wherein said top side edge of each of said arms has a row of resilient teeth extending therealong, and wherein said upper side wall of each of said elongate bores has a row of resilient teeth extending therealong, wherein said teeth of said upper side wall interlockingly engage said teeth of the associated top side edge to resist sliding of the arm in the associated elongate bore.

6. The garment hanger of claim 1, wherein said lower side wall of each of said elongate bores has a notch therein located between the associated wnd wall and the proximal end of the associated shoulder wing, said terminal end of each of said arms having a detent, said detents being insertable into the notch of the associated elongate bore to prevent positioning of the associated shoulder wing outwards past said extended position.

7. A garment hanger, comprising:

a mast member having upper and lower ends, and a longitudinal axis extending between said upper and lower ends;

a hook upwardly extending from said upper end of said mast member, said hook being adapted for hooking on to a support structure such that said longitudinal axis of said mast member is generally vertical extended beneath said support structure;

a pair of elongate arms outwardly extending in generally diametrically opposite directions from said mast member adjacent said lower end of said mast member;

each of said arms having terminal end and generally straight top and bottom side edges extending between the associated terminal end and said mast member;

each of said arms having a longitudinal axis extending between the associated terminal end and said mast member;

said longitudinal axes of said arms being generally collinear;

said longitudinal axes of said arms being extended generally perpendicular to said longitudinal axis of said mast member such that said longitudinal axes of said arms are generally horizontal when said mast member is suspended from a support structure;

said longitudinal axes of said mast member and said arms generally lying in a common plane;

each of said arms having a generally rectangular cross section transverse the associated longitudinal axis of the respective arm;

said mast member having a reinforcing portion adjacent said top side edges of said arms, said reinforcing portion generally triangular in configuration and having a pair of upper edges, one of said upper edges of said reinforcing portion being extended between said mast member and said top side edge of one of said arms, another of said upper edges of said reinforcing portion being extended between said mast member and said top side edge of another of said arms;

wherein said upper edges of said reinforcing portion each extend at an acute angle with respect to the longitudinal axis of the associated arm;

a pair of shoulder wings each having a generally straight proximal end and an arcuate distal end;

said proximal end of each of said shoulder wings having an elongate bore therein;

said elongate bores of said shoulder wings each having a longitudinal axis and a generally rectangular cross section transverse the longitudinal axis of the respective elongate bore;

each of said elongate bores of said shoulder wings terminating at an end wall located between the proximal and distal ends of the respective shoulder wing;

each of said elongate bores of said shoulder wings having generally straight upper and lower side walls extending between the associated end wall and the proximal end of the respective shoulder wing;

one of said arms being inserted into the elongate bore of one of said shoulder wings, another of said arms being inserted into the elongate bore of another of said shoulder wing, said arms being slidable along the longitudinal axis of the associated elongate bore;

each of said shoulder wings being positionable between a retracted position and an extended position, wherein said proximal ends of said shoulder wings are positioned adjacent said mast member when in said retracted position, wherein said proximal ends of said shoulder wings are spaced apart from said mast member when in said extended position;

said upper side wall of each of said elongate bores having a generally triangular recess adjacent the associated proximal end of the respective shoulder wing adapted for receiving the adjacent associated upper edge of said reinforcing portion when said shoulder wings are in said retracted position;

said distal ends of said shoulder wings defining a length therebetween, wherein said length between said distal ends is about 16 inches when said shoulder wings are in said retracted position, wherein said length between said distal ends is about 24 inches when said shoulder wings are in said extended position;

said top side edge of each of said arms having a row of resilient teeth extending therealong;

said upper side wall of each of said elongate bores having a row of resilient teeth extending therealong, said teeth of said upper side wall interlockingly engaging said teeth of the associated top side edge to resist sliding of the shoulder wings along the associated arm;

said lower side wall of each of said elongate bores having a notch therein located between the associated end wall and the proximal end of the associated shoulder wing; and said terminal end of each of said arms having a detent, said detents being insertable into the notch of the associated elongate bore to prevent positioning of the associated shoulder wing outwards past said extended position.

* * * * *